United States Patent [19]

Kamp

[11] Patent Number: 4,951,022

[45] Date of Patent: Aug. 21, 1990

[54] SENSITIVE LATCH AND TRIP MECHANISM

[75] Inventor: Eugene L. Kamp, Fulton, Mo.

[73] Assignee: A. B. Chance Company, Centralia, Mo.

[21] Appl. No.: 285,089

[22] Filed: Dec. 15, 1988

[51] Int. Cl.[5] ..... H01H 9/20

[52] U.S. Cl. ..... 335/167; 335/21

[58] Field of Search ..... 335/167–175, 335/21–24, 6–10, 35; 200/317, 325

[56] References Cited

U.S. PATENT DOCUMENTS

| | | | |
|---|---|---|---|
| 2,048,114 | 7/1936 | Gano et al. . | |
| 3,046,371 | 7/1962 | Jencks . | |
| 3,222,475 | 12/1965 | Woods et al. . | |
| 3,317,867 | 5/1967 | Powell | 335/172 |
| 3,605,052 | 9/1971 | Dimond et al. . | |
| 4,119,935 | 10/1978 | Wien et al. . | |
| 4,246,557 | 1/1981 | Michetti et al. . | |
| 4,459,672 | 7/1984 | Fajner et al. . | |
| 4,475,094 | 10/1984 | Grenier et al. | 335/21 |
| 4,622,530 | 11/1986 | Ciarcia et al. . | |

OTHER PUBLICATIONS

*Advanced Diemaking*, by D. Eugene Ostergaard, 1967, pp. 116–118.

*Primary Examiner*—Leo P. Picard
*Assistant Examiner*—Lincoln Donovan
*Attorney, Agent, or Firm*—Hovey, Williams, Timmons & Collins

[57] ABSTRACT

A sensitive latch and trip mechanism includes a latch plate supported for pivotal movement under the influence of a load, and a latch lever supported for pivotal movement about a lever axis. The lever includes a latching surface disposed in a latching surface plane and a lever axis located a distance A from the latching surface plane in a direction perpendicular to the latching surface plane and offset from the latching surface by a distance B in a direction parallel to with both the latching surface plane and the plane in which the latch plate pivots. A coefficient of friction is defined between the latching surface and a surface of the latch plate interengaged therewith, the coefficient of friction U being correlated with the distances A and B to follow the relationship $U \geqq B/A$. In this manner, the lever may be easily pivoted from its latching position to unlatch the plate.

13 Claims, 1 Drawing Sheet

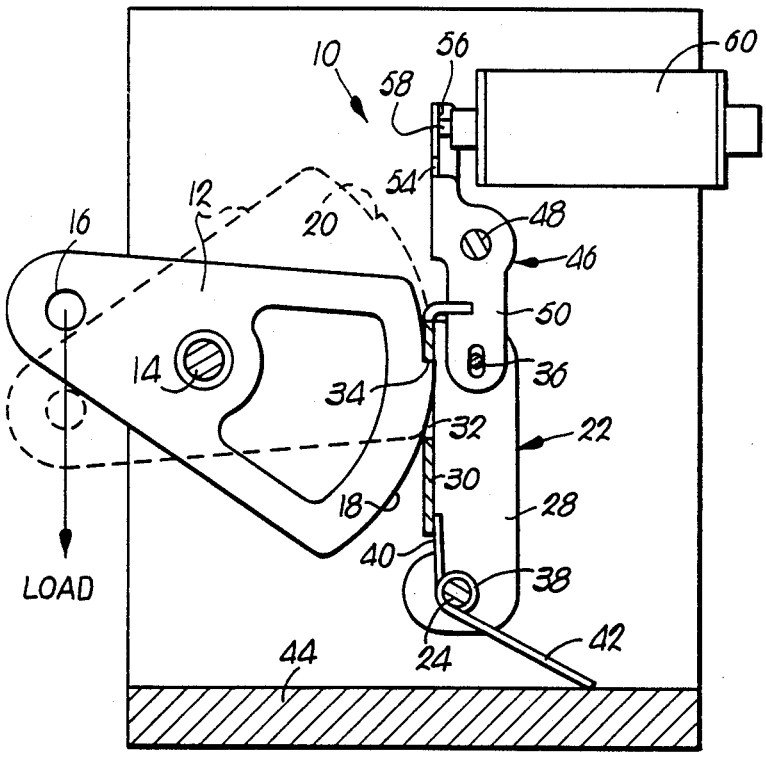
Fig.2.
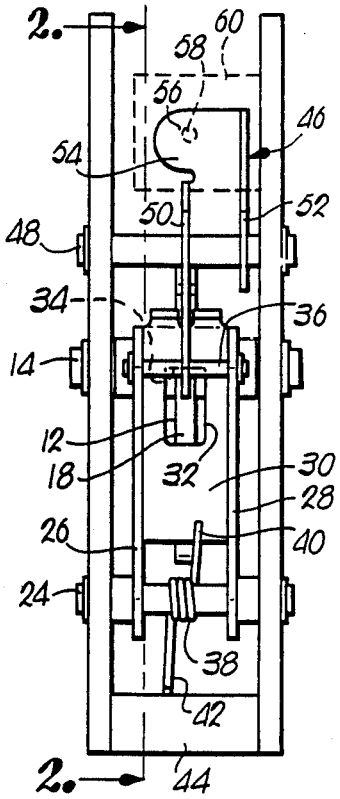
Fig.1.
Fig.3.
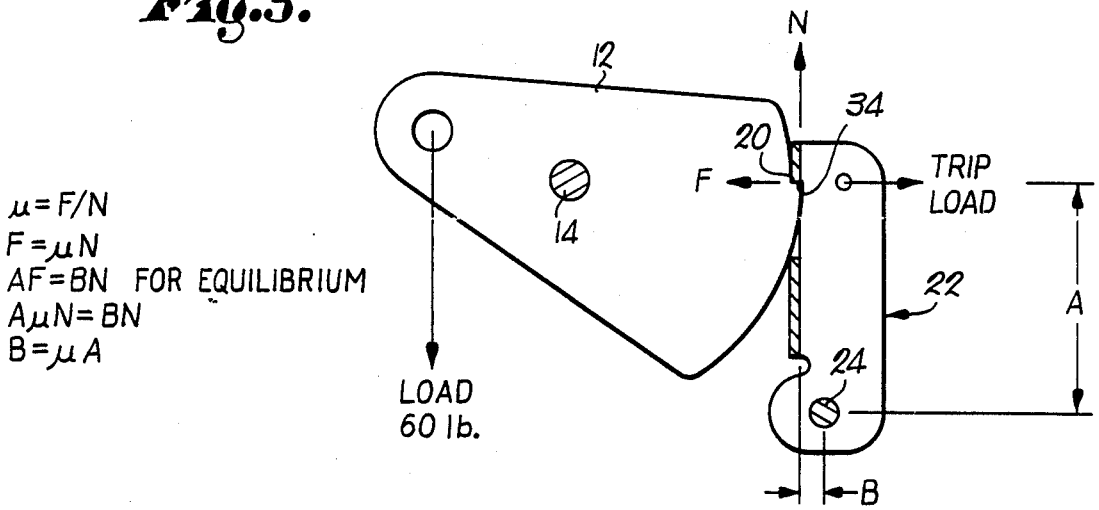

SENSITIVE LATCH AND TRIP MECHANISM

BACKGROUND OF THE INVENTION

1. Field of the Invention

The present invention relates generally to latches and, more particularly, to a sensitive latch and trip mechanism therefor.

2. Description of the Prior Art

Latch and trip mechanisms are commonly employed in devices such as circuit breakers to provide a quick cut-off of electricity passing through a circuit. An example of such a circuit breaker is illustrated in U.S. Pat. No. 4,622,530, to Ciarcia et al. According to the Ciarcia et al. patent, a trip unit is employed which utilizes primary and secondary latches disposed in a geometric arrangement designed to reduce the breaker trip force and to increase the yield of acceptable circuit breaker assemblies produced in a typical assembly process.

In the Ciarcia et al. patent, the primary latch assembly includes a cradle and a primary latch, each of which is pivotal about an axis and is provided with a surface which engages the surface of the other. The primary latch also includes a second surface, and a secondary latch is pivotally mounted for movement into and out of engagement with this second surface.

The relationship between the two latches and the cradle of the trip mechanism is defined to reduce the tripping force of the mechanism.

OBJECTS AND SUMMARY OF THE INVENTION

It is an object of the present invention to reduce the number of parts required to construct a sensitive latch and trip mechanism, while increasing the speed of operation and reliability of the device. Since the device may be used in circuit breakers that possibly sit unused or unactuated for long periods of time, it is also an object to ensure proper operation of the mechanism even after such periods of non-use.

In addition, the inventive mechanism provides for a more consistent operation of the mechanism over a wide range of applied loads.

In accordance with the invention, a latch and trip mechanism includes a latch plate presenting a first latching surface, and means for supporting the latch plate for pivotal movement within a first plane under the influence of a load applied to the plate. A latch lever is provided which presents a second latching surface disposed in a latching surface plane. The lever is supported for pivotal movement about a lever axis which is located a distance A from the latching surface in a direction perpendicular thereto, and which is offset from the second latching surface by a distance B in a direction parallel to both the first plane and the latching surface plane. The plate and lever are oriented for interengagement between the first and second latching surfaces with a coefficient of friction U being defined therebetween. The coefficient of friction and the distances A and B are correlated to follow the relationship $U \geqq B/A$.

In addition, a coating may be applied to the latching surfaces wherein the coating is of a material having a substantially consistent coefficient of friction between the surfaces over a wide range of applied loads. The coating material is preferably polytetrafluorethylene (TEFLON) having a coefficient of friction in the range of about 0.1 to 0.14.

The mechanism may further be constructed so that the coefficient of friction and the distances A and B are correlated to follow the relationship that U is substantially equal to B/A. When this relationship is employed, or when U is slightly greater than B/A, it is preferred that the mechanism includes a spring or other biasing means for applying a predetermined biasing force on the lever in a direction toward and perpendicular to the plate axis, and an actuator for exerting an actuating force on the lever in a direction opposite to the biasing force, with the actuating force being greater than the biasing force so that the lever is tripped and the plate is unlatched.

BRIEF DESCRIPTION OF THE DRAWING FIGURES

A preferred embodiment of the present invention is discussed below with reference to the drawings wherein:

FIG. 1 is an end view of a sensitive latch and trip mechanism in accordance with the invention;

FIG. 2 is a sectional view taken along line 2—2 of FIG. 1; and

FIG. 3 is a schematic diagram of the latch plate and latch lever of the inventive mechanism.

DETAILED DESCRIPTION OF THE PREFERRED EMBODIMENT

A sensitive latch and trip mechanism constructed in accordance with the present invention is illustrated in FIGS. 1 and 2. Only those parts necessary for an understanding of the invention are shown and it is noted that the mechanism may be employed to release any load for which such a quick release is desired.

In FIG. 2, the mechanism 10 is shown as including a generally pie-shaped latch plate 12 mounted for pivotal movement about a plate axis 14. A hole 16 is provided at one end of the plate 12 and is adapted to be connected with a load which is restrained by the mechanism 10 until released thereby. However, it is noted that the load may be applied at other points of the plate as well, such as at a point between the lever axis and the second end of the plate 12 opposite the small end. This second end has a curved surface 18 including a stepped portion which presents a latching surface 20 that may be engaged in a manner to be described in order to restrain the load acting on the plate 12. The latching surface is preferably coplanar with the plate axis.

A latch lever 22 is provided adjacent to the latch plate 12 and is mounted for pivotal movement about a lever axis 24 which is parallel to the plate axis 14. As illustrated in FIG. 1, the lever includes two side plates 26, 28 which are disposed in planes generally parallel with the plane of the latch plate 12. A front plate 30 extends between the side plates 26, 28 in a direction perpendicular to the latch plate 12 and is provided with an opening 32 defining a second latching surface 34 adapted to engage the latching surface 20 of the latch plate 12. In addition, the lever 22 also includes a pin 36 extending between the side plates 26, 28 engageable by an actuating means for pivoting the lever 22 about the lever axis 24 and releasing the load.

A coil spring 38 having protruding end sections 40, 42 is disposed about the lever axis so that one end 40 of the spring 38 is in normal contact with the front plate 30 of the lever 22 while the other end is in contact with another body member 44 of the mechanism which does not move with the lever. In this manner, a biasing force is constantly applied to the lever 22 in a direction toward and perpendicular to the plate axis.

The pin 36 is engaged by an actuator lever 46 which is mounted about an actuator lever axis 48 for pivotal movement. The actuator lever 46 includes a pair of side plates 50, 52, only one of which engages the pin 36. A front plate 54 extends between the side plates 50, 52 and includes a contact surface 56 against which an electromagnetically actuated plunger 58 impacts to pivot the lever 46 about the axis 48. An electromagnet 60 provides the actuation.

Although the actuator is shown to be of the impact type, it is noted that the plunger could be connected to the opposite side of the front plate 54 than that shown and could be actuated by a pull type actuator. In addition, the spring and actuator could be positioned elsewhere on the lever so long as a spring force biases the lever toward the plate and the actuator operates to overcome the spring force, Alternatively, the actuator could provide the biasing force and be deactivated to permit the spring to trip the lever.

In FIG. 3, the geometry of the inventive mechanism is illustrated. Upon the application of a load to the small end of the plate 12, a normal force N and a friction force F are exerted by the plate 12 on the lever 22. The normal force N acts in a direction perpendicular to the latching surface 34. The friction force F acts in the plane of the surface 34 and has a magnitude equal to the force N multiplied by the coefficient of friction. Any trip load applied to the lever 22 must typically overcome this friction force. However, by offsetting the latching surface 34 a distance B from a radial line extending from the lever axis 24 in a direction perpendicular to the plane in which the second latching surface 34 is disposed, it is possible for the structure of the device to provide a built-in offset of the friction force so that the trip load need not overcome any of the friction force at all. This result is accomplished, in the preferred embodiment shown in FIG. 3, by offsetting the latching surface 34 a distance B from the lever axis 24 so that a moment results from the exertion of the normal force on the surface 34. This moment has a magnitude of N·B. In addition, by adjusting the amount of offset B, the moment of the normal force N can be adjusted so that it can be made to be equal to or less than the friction force F so that the lever 22 rests against the plate 12 with any desired amount of force.

For example, in order to construct the device so that no net moment force acts on the lever 22, the force F must equal the force N multiplied by the coefficient of friction U between the two surfaces 20, 34. The relationship between the moments acting on the lever 22 is as follows:

$$AF = BN;$$

which, from the previous relationship, may also be expressed as follows: $AUN = BN$, or as $B = UA$. Thus, in order for no net moment force to act, the ratio B/A must equal the coefficient of friction U between the surfaces 20, 34.

If it is desired to maintain some net moment force in the direction of the friction force, the ratio B/A may be made somewhat smaller than the coefficient of friction.

Returning to the mechanism as shown in FIGS. 1 and 2, by adding the spring 38 to the system of FIG. 3, it is possible to apply any desired amount of biasing force to the lever 22 to ensure that the lever is not errantly pivoted from its latching position, and the actuator can be designed to overcome the specific biasing force to trip the latch. In this manner, it is easy to control the action of the latch lever regardless of the load acting on the latch plate 12. In addition, it permits the mechanism to be designed for any desired tripping force since the only force to be considered during the tripping movement are the spring force and the actuating force, both of which are determined by the designer.

In order to further improve the operation of the mechanism, a coating may be applied to one or both of the latching surfaces 20, 34 to ensure that the coefficient of friction between the surfaces remains substantially consistent over a wide range of applied loads. For example, by providing a coating of polytetrafluorethylene (TEFLON), the coefficient of friction may be maintained at a substantially constant value within the range of 0.08 to 0.15. This coating also provides the advantage of protecting against sticking together of the surfaces during long periods of non-use to ensure proper operation.

Although the invention has been described with reference to the illustrated embodiment, the invention is not so limited, and substitutes may be made and equivalents employed herein without departing from the scope of the invention as set forth in the claim. For example, although the preferred embodiment of the inventive method illustrates the use of an offset latching surface on the lever to accomplish a balancing or near balancing of moments of acting on the latch lever, it is within the scope of the invention that such a balancing could be carried out in other ways such as by angling the latching surface relative to the lever axis to balance the moment. This alternative is especially workable with larger latch mechanisms where large tolerances exist, since small latches have tight tolerances where angled surfaces are employed and wear of the surfaces reduces the reliability thereof.

What is claimed is:

1. A sensitive latch and trip mechanism comprising:

a latch plate including a pivot axis and presenting a first latching surface disposed in a reference plane that is substantially radial to the pivot axis;

means for supporting the latch plate for pivotal movement about the pivot axis within a first plane under the influence of a load applied to the plate;

a latch lever presenting a second latching surface disposed in a latching surface plane;

means for supporting the lever for pivotal movement about a lever axis, the lever axis being located a distance A from the latching surface plane in a direction perpendicular to the latching surface plane, and being offset from the second latching surface by a distance B in a direction parallel to both the first plane and the latching surface plane, the plate and lever being oriented for interengagement between the first and the second latching surfaces, a coefficient of friction U being defined between the surfaces, the coefficient of friction and the distances A and B being correlated to follow the relationship $U \geqq B/A$; and means for selectively pivoting the lever about the lever axis in a direction for unlatching the latching plate.

2. The sensitive latch and trip mechanism according to claim 1, wherein the first and second surfaces include a coating of material having a substantially consistent coefficient of friction therebetween over a wide range of applied loads.

3. The sensitive latch and trip mechanism according to claim 2, wherein the coating material is polytetrafluorethylene.

4. The sensitive latch and trip mechanism according to claim 2, wherein the coefficient of friction is within the range of about 0.08 to 0.15.

5. The sensitive latch and trip mechanism according to claim 1, wherein the coefficient of friction and the distances A and B are correlated to follow the relationship that U is substantially equal to B/A, the mechanism further comprising:

biasing means for applying a predetermined biasing force on the lever in a direction toward and perpendicular to the plate axis; and actuating means for exerting an actuating force on the lever in a direction opposite to the biasing force, the actuating force being greater than the biasing force so that the lever is tripped and the plate is unlatched.

6. The sensitive latch and trip mechanism according to claim 5, wherein the biasing means is a spring.

7. The sensitive latch and trip mechanism according to claim 5, wherein the actuating means includes an actuator lever mounted for pivotal movement about an actuator lever axis, and an electromagnetic actuator, the actuator lever being connected between the actuator and the latch lever to transmit the actuating force generated by the actuator to the latch lever.

8. A sensitive latch and trip mechanism comprising:

a latch plate including a plate axis and presenting a first latching surface disposed in a reference plane that is substantially radial to the plate axis;

means for supporting the latch plate for pivotal movement about the plate axis under the influence of a load applied to the latch plate;

a latch lever presenting a second latching surface;

means for supporting the latch lever for pivotal movement about a lever axis, the plate and lever being oriented for interengagement between the first and second latching surfaces, the first and second surfaces being oriented relative to the lever axis so that when a load is applied to the plate, the moment force exerted on the lever by the plate is equal and opposite to the moment force exerted on the lever due to the coefficient of friction;

biasing means for applying a predetermined biasing force on the lever in a direction toward and perpendicular to the plate axis; and actuating means for exerting an actuating force on the lever in a direction opposite to the biasing force, the actuating force being greater than the biasing force so that the lever is tripped and the plate is unlatched.

9. The sensitive latch and trip mechanism according to claim 5, wherein the biasing means is a spring.

10. The sensitive latch and trip mechanism according to claim 8, wherein the actuating means includes an actuator lever mounted for pivotal movement about an actuator lever axis, and an electromagnetic actuator, the actuator lever being connected between the actuator and the latch lever to transmit the actuating force generated by the actuator to the latch lever.

11. The sensitive latch and trip mechanism according to claim 8, wherein the first and second surfaces include a coating of material having a substantially consistent coefficient of friction therebetween over a wide range of applied loads.

12. The sensitive latch and trip mechanism according to claim 11, wherein the coating material is polytetrafluorethylene.

13. The sensitive latch and trip mechanism according to claim 11, wherein the coefficient of friction is within the range of about 0.08 to 0.15.

* * * * *